United States Patent [19]

Hoene et al.

[11] Patent Number: 4,727,228

[45] Date of Patent: Feb. 23, 1988

[54] CONTACT ARRANGEMENT FOR VACUUM SWITCHES

[75] Inventors: Ernst-Ludwig Hoene; Roman Renz, both of Berlin, Fed. Rep. of Germany

[73] Assignee: Siemens Aktiengesellschaft, Berlin and Munich, Fed. Rep. of Germany

[21] Appl. No.: 768,148

[22] Filed: Aug. 22, 1985

[30] Foreign Application Priority Data

Sep. 28, 1984 [DE] Fed. Rep. of Germany ..... 3435815

[51] Int. Cl.[4] ..... H01H 33/66

[52] U.S. Cl. ..... 200/144 B

[58] Field of Search ..... 200/144 B

[56] References Cited

U.S. PATENT DOCUMENTS 4,196,327 4/1980 Kurosawa et al. ..... 200/144 B

FOREIGN PATENT DOCUMENTS 1598397 9/1981 United Kingdom .

*Primary Examiner*—Robert S. Macon

*Attorney, Agent, or Firm*—Hill, Van Santen, Steadman & Simpson

[57] ABSTRACT

A contact arrangement for a vacuum switch or vacuum circuit breaker having coaxial switch contacts with a high breaking capacity in combination with a low current chopping and with an axial magnetic field with locally different field strength being generated in the region of the switch contacts characterized by each contact member of the contact arrangement having at least one contact surface and one arc-focusing surface with that the contact surface being in a region of low field strength of the axial magnetic field and the arc-focusing surface being in a region of high field strength of the magnetic field. The contact surface is formed in an element of a low-surge material while the arc-focusing surface is formed in an element having a high breaking capacity. Due to the structural design of the contact surfaces, the breaking arc is always ignited in the region of the contact surfaces and the contact arrangement is suitable for vacuum switches with high short-circuit breaking current values.

14 Claims, 8 Drawing Figures

CONTACT ARRANGEMENT FOR VACUUM SWITCHES

BACKGROUND OF THE INVENTION

The present invention is directed to a contact arrangement for a vacuum circuit breaker which has a pair of contact members and an arrangement for generating a magnetic field in an axial direction including current loops with each contact member having at least one contact surface for making contact with the contact surface of the other of the pair of members, said current loops generating different axial magnetic field strengths in the radial direction of the contact arrangement.

A vacuum circuit breaker, which has a contact arrangement of a pair of contact members with one of the members movable on an axis of the arrangement, means for generating a magnetic field in an axial direction including current loops in each of the contact members, each contact member having at least one contact surface for making contact with the contact surface of the other of the pair of members and the current loops generating different field strengths in the axial direction, is disclosed in U.S. Pat. No. 4,196,327 whose disclosure is incorporated by reference thereto. As disclosed in this patent, behind each of the contact members are current loops which generate regions of higher and regions of lower magnetic field strength in an axial direction in the contact member and in the contact surfaces. The high magnetic field strengths in neighboring regions may have an opposite polarity.

These vacuum switches are distinguished by a rapid dielectrical re-solidification of the contact-break distance after the zero-axis crossing of the current or the breaking of the arc. This advantage of the vacuum switches can have a negative influence given unfavorable circuit data or, respectively, electrical conditions in the network, for example, when motors, which are starting up, are disconnected. Premature zero-axis crossing of the current having great steepness can, namely, occur and leads to the phenomena which are referred to in the literature as "multiple re-ignitions" and which can lead to disruptive overvoltages given breaking currents $<1$ kA in the network.

In order to keep this effect low, the contact-break distance in the prior are is influenced such that the breaking current strength is kept low, whereby the overvoltages are reduced in accordance with the general opinion. This is achieved by means of an appropriate selected contact material of so-called "low-surge material". Examples of this material are composite chrome-copper materials with a bismuth or tellerium additive. Particularly because of their high vapor pressure, however, such materials only have a relatively low maximum breaking capacity or capability. Re-ignition also easily occurs here when breaking currents which, for example, amount to more than 10 kA occur and thus the shutoff is not for sure.

In British Patent Specification 1,598,397, a vacuum circuit breaker is disclosed with a contact arrangement where contacts with a rotating arc are divided into a main contact part and an auxiliary contact parts. The main contact part of the two contact members are brought into contact with one another when the switch or circuit breaker is closed but the auxiliary contact parts are not. Due to the current management in the contact disclosed therein, the arc is to be displaced from the main contact part into the auxiliary contact part.

The main contact part comprises a low-surge material and the auxiliary contact part comprises a material for a high breaking capacity. As a result of the special shaping of these contacts, a weak current only generates an arc in the region of the main contacts herein the arc of a strong current will migrate to the auxiliary contact part where it encounters a material having the high breaking capacity. The electromotive forces that act on the arc occurs due to the current flux and the contact shape.

Due to the unstable behavior of the arc burning contracted given high current strengths, however, it is not always guaranteed that this arc will leave the main contact surface quickly enough that a thermal overload thereof is reliably excluded.

SUMMARY OF THE INVENTION

The object of the present invention is to provide a contact arrangement which has sufficiently low re-solidification of the dielectric on the one hand when disconnecting currents that are about equal to or less than a nominal current and which, on the other hand, guarantees a high breaking capacity given higher currents.

To accomplish these goals, the present invention is directed to an improvement in a contact arrangement for use in a vacuum switch which has means for generating a magnetic field in an axial direction of the contact arrangement and includes current loops. The contact arrangement has a pair of contacts while each contact member has at least one contact surface for making contact with the contact surface of the other of the pair of members, and said current loops generating different field strengths in the axial direction. The improvements are that each contact member has at least on arc-focusing surface in the proximity of the contact surface, said arc-focusing surface of the pair being opposite each other in an axial direction, each of the contact member being shaped with the breaking current occurring or arising only at the contact surface, said current loops of the means creating the magnetic field with a smaller axial magnetic field in the area of the contact surface than the axial magnetic field at each arc-focusing surface, and said contact member being composed of a low-surge material in the region of the contact surface and a material with a higher breaking capability in the region of each arc focusing surface.

The invention is based on the perception that a metal vapor arc in the vacuum switch tube or vacuum circuit breaker transforms into a diffusely burning condition under the influence of the axial magnetic field after ignition with a commutation time $t_o$ which drops with the increasing current strength, for example, to 3 ms at 10 kA. The transforming ocurrs namely in the contact region in which the specific induction $B_Z/I$ created by the axial magnetic field component reaches a minimum value. In the diffusely burning condition, the arc-burning voltage lies multiples below the value of the arc-burning voltage in the contracted arc. In the contact arrangement of the invention, a corresponding shape and arrangement guarantees that when separating the contacts the arc is first created between the contact surfaces and specifically in the low surge region. Under the influence of the axial magnetic field, the arc burning in concentrated fashion dislocates quickly within $t_o$ into the region of the maximum magnetic field strength wherein depending on the local field distribution, it changes into a diffused arc or into a plurality of diffusedly burning sub-arcs. As already known, it burns there with a greatly reduced arc-burning voltage on contact surfaces having a higher loadability. Thus, this prevents the contact surfaces, which are composed of the so-called low-surge material, from being thermally overloaded and guarantees that the arc, after $t_o$, burns in the region of the arc-focusing surfaces suitable for high breaking capacities and thus guarantee a high breaking capability of the contact arrangement.

The current loop of the device can be applied to one or both of the contacts or be fixed in some other fashion in their position relative to the contact such that their magnetic field is significantly lower in the points or regions of the contact surfaces which are composed of low-surge contact material than in the arc-focusing surfaces having the higher loadable contact material. As long as this condition is met, arbitrary forms of current loops can be utilized.

An advantageious embodiment of the contact arrangement of the invention is that the contact surfaces but not the arc-focusing surfaces of the contact member can be brought into contact with the correspondong surfaces of the second contact member. It is thus guaranteed in a simple fashion that the arc is drawn only in the region of the contact surfaces. An embodiment comprising only one arc-focusing surface in which only a diffused arc occurs is established in that the contact surfaces present an annulus in that the arc-focusing surface follows concentrically upon this annulus in the inside thereof. The arc-focusing surface can thereby completely fill the annulus formed by the contact surface or can be annularly-shaped itself. A diffusingly burning arc will fill out the entire arc-focusing surface in either type structure.

An embodiment having a plurality of diffusingly burning arcs is achieved in that the contact surface presents a circular disk concentric to the contact axis and in that the arc-focusing surfaces lie on a ring surrounding the contact surface. This execution is particularly advantageous in the combination with generating the axial magnetic field by means of conductor loops when the conductor loops are disposed at the side of the contact member facing away from the contact surface. As disclosed in the above-mentioned U.S. Pat. No. 4,196,327, the loops encompass only one segment of an annulus. In this case, field-free zones occur in the center of the annulus and the region of the boundary of the sectors. Field-free in this context means free of an axial field which is created by the current in the conductor loop. Given this embodiment, two or more arc-focusing surfaces can be produced on the ring in a particularly simple fashion whereby the arc-focusing surfaces are permeated by an axially magnetic field having a differing field direction.

A diffused arc in the focusing surface is guaranteed when the current-related specific field strength in the axial direction of the contact surface under and in the arc-focusing surfaces lie above 1.5 $\mu$T/A. The value 3 $\mu$T/A should thereby be at least reached in the region of the maximum field strength of the arc-focusing surface so that the arc-burning voltage reaches its minimum. In such an embodiment, the arc migrates from the location of the arc ignition point into the arc-focusing surface within $t_o$ and transforms into diffusely burning condition given current strengths above the value at which the appearance of multiple re-ignition must be anticipated.

The diffused arc burns uniformly and its arc voltage drop is lower by a multiple than that of the contracted arc. This advantage comes into effect particularly given currents of more than 10 kA at which the arc burns contracted without an axial magnetic field and has an unstable behavior as experience has taught.

Chrome-copper is suitable as a contact material for the arc-focusing surfaces. This material guarantees a high breaking capacity.

DESCRIPTION OF THE PREFERRED EMBODIMENTS

Figure 2:
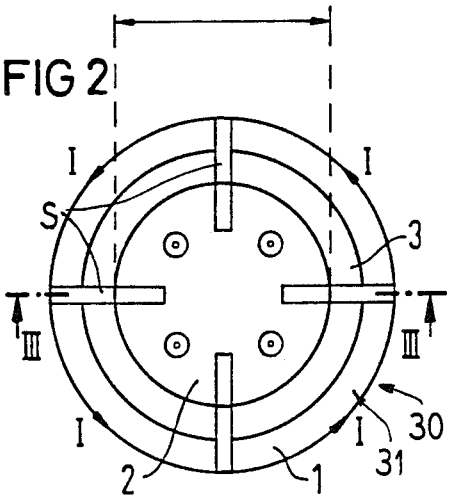
FIG. 2 is a plan view of a contact member in accordance with the present invention.
Figure 3:
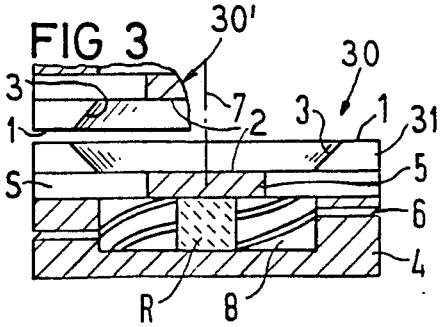
FIG. 3 is a cross-sectional view taken along lines III—III of FIG. 2 of the contact member with a portion of the other contact member of the pair.
Figure 8:
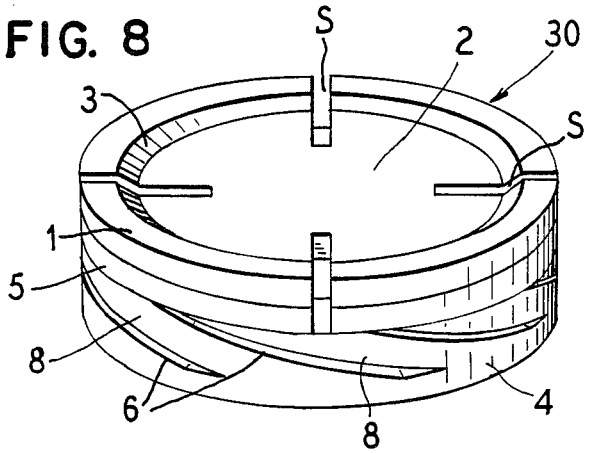

The principles of the present invention are particularly useful in a contact member generally indicated at 30 in FIGS. 2, 3 and 8. The contact member 30 as well as the other member 30' of the pair of members, has an annular main contact surface 1, an arc-focusing surface 2 with a transmission region 3 which has a shape of a conical frustum surrounding the surface 2. The main or annular contact surface 1 as well as the transmission region 3 are formed in a member 31 composed of a low-surge material so that no disruptive current chopping can arise there. The arc-focusing surface 2 is provided on a contact disk 5 which is of a contact material with a high breaking capacity, for example, chrome-copper.

As illustrated in FIG. 3, the member 30 has a rotational axis 7 and includes a carrier 4 of a material having a good electrical conductivity. The carrier 4 has a pot-like cross-section and has slots 6 in a wall of the carrier to form spiral webs or spokes 8. The slots describe a relatively large angle with the rotational axis 7 so that the axial magnetic field component is generated. This angle amounts to approximately 70°. On an axis of the carrier 4, a rotational solid R of a ceramic or metal is provided so that the contact has stability between the disk 5 and the carrier 4.

The webs 8 form subsections of conductor loops for generating the magentic field having an axial component. The axial component of the magnetic field is directed toward the contact disk 5 in the area of the arc-focusing surface 2 and has a current-related minimum inductance $B_Z(min)/I$ of 1.5 uT/A.

The ring-like member or element 31 in which the transition surface 3 and the contact surface 1 are formed is a ring of low-surge material whose dimensions guarantee that the current-related minimum inductance $B_Z(min)/I$ is exceeded within the transition zone. This ring of low-surge material and the contact disk 5 are expediently provided with radial slots S in order to avoid the formation of eddy currents in the contact member which can reduce the axial field component to a remainder of about 30%.

This embodiment forms a diffusedly burning arc region which fills out the entire arc-focusing surface 2. The maximum specific inductance $B_Z(max)/I$ thereby lies in the region of the rotational axis 7 of the contact. It exceeds the value 3 $\mu$T/A (unipole contact).

Figure 5:
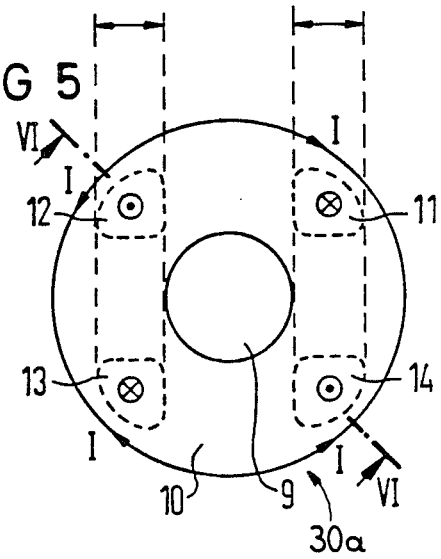
FIG. 5 is a plan view of the embodiment of the contact member of the present invention.
Figure 6:
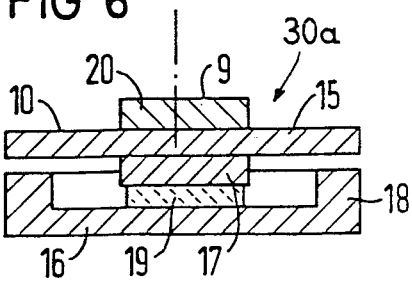
FIG. 6 is a cross-sectional view taken along lines VI—VI of FIG. 5.
Figure 7:
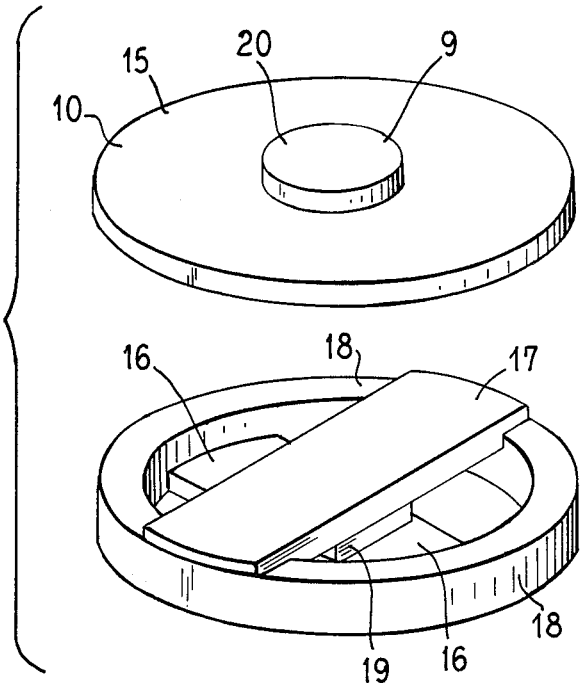
FIG. 7 is an exploded prospective view of the contact member of FIGS. 5 and 6 and FIG. 8 is a prospective view of the contact member of FIGS. 2 and 3.

An embodiment of the contact member is generally indicated at 30*a* in FIGS. 5, 6 and 7. The member 30*a* comprises a disk-shaped contact surface 9 of a disk 20 and a concentric ring 10 which is composed of a material for high breaking capacities, for example, chrome-copper. Conductor loops are disposed behind the ring 10 and are traversed by parts of the current flowing across the contact. The magnetic field is created by the loops defining the arc-focusing surfaces 11–14 on the contact ring 10 in which the minimum value for the specific inductance $B_Z(min)/I$ is exceeded. The field thereby changes its direction (multipole contact) between respectively neighboring arc-focusing surfaces 11 through 14.

A simple embodiment of such a contact member is established in that the contact ring 10 is part of the contact disk 15 and in that the disk 20 of a low-surge material is concentrically applied on the contact disk 15. The magnetic field acting in an axial direction is formed by a known winding arrangement in the form of a spoked wheel whereby spokes 16 and 17 extend perpendicular to each other and to a ring 18. The spokes 16 and 17 are supported against one another in an axial direction by a supporting member 19 having a low electrical conductivity. The current flows from the spoke 16 through the ring 18 and the spoke 17 and then to the contact disk 15.

Figure 1:
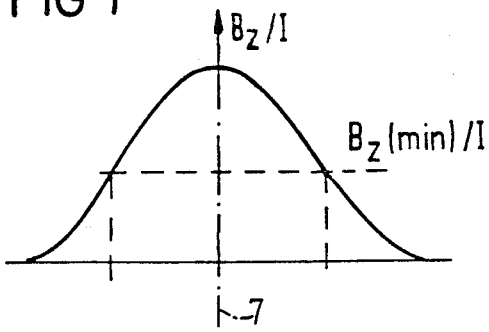
FIG. 1 is a graph illustrating distribution of specific inductances along the axial direction relative to a radial spacing from the axis of the contact.
Figure 4:
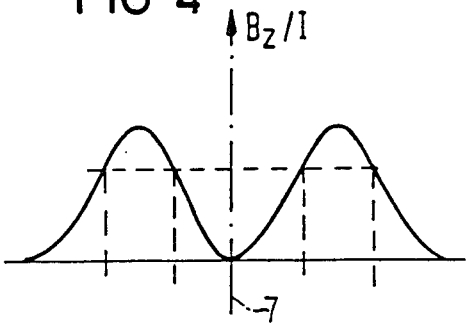
FIG. 4 is a graph presenting the distribution of specific inductance along the axial direction relative to the axis of an embodiment of a contact member.

In this embodiment, the minimum value of the specific inductance is reached in the arc-focusing surfaces but the peak value of the specific induction is lower than in the embodiment of FIG. 1. Since in this arrangement the migration of the arc into the arc-focusing surfaces is provided by the current force with displacement of the arc toward the outside in a radial direction, a certain spacing between the contact surface 9 and the arc-focusing surfaces 11 through 14 are permissible.

Although various minor modifications may be suggested by those versed in the art, it should be understood that we wish to embody within the scope of the patent granted hereon, all such modifications as reasonably and properly come within the scope of our contribution to the art.

We claim:

1. In a contact arrangement for use in a vacuum switch having means for generating a magnetic field in an axial direction of the switch including current loops, said contact arrangement containing a pair of contact members, each member having at least one contact surface for making contact with a contact surface of the other of the pair of members, said current loops generating different axial magnetic field strengths in the radial direction, the improvements comprising each of said contact members having at least one arc-focusing surface in the proximity of the contact surface, said arc-focusing surface of the pair being opposite each other in an axial direction, each of the contact members being shaped with the breaking arc arising only at the contact surface, said means creating the magnetic axial field with a smaller strength in the area of the contact surface than at each arc-focusing surface, and each of said contact members being composed of a low-surge material in the region of the contact surface and a material with a higher breaking capability in the region of each of the arc-focusing surfaces.

2. In a contact arrangement according to claim 1, wherein the contact surface of each of said members is on a different level than the arc-focusing surfaces so that when said pair of contact members are brought together, the contact surfaces engage each other and the arc-focusing surfaces are spaced apart.

3. In a contact arrangement according to claim 2, wherein the contact surface has a shape of an annulus surrounding the axis and the arc-focusing surface, each of said contact members having a transition zone of the same material as the contact surface extending between the arc-focusing surface and contact surface and concentric therewith.

4. In a contact arrangement according to claim 3, wherein the current related specific field strength in an axial direction in the area of the arc-focusing surface lies above 1.5 $\mu$T/A.

5. In a contact arrangement according to claim 4, wherein the field strength in the axial direction amounts to at least 3 $\mu$T/A in the region of the maximum field strength for the arc-focusing surfaces.

6. In a contact arrangement according to claim 2, wherein the contact surface is a circular disk concentrically arranged to the axis of each of said contact members, and the device includes at least one arc-focusing surface lying on an annulus surrounding the contact surface.

7. In a contact arrangement according to claim 6, wherein at least two arc-focusing surfaces lie on the annulus, and wherein the means for generating the axial magnetic fields creates magentic fields having different field directions.

8. In a contact arrangement according to claim 6, wherein the current related specific field strength in an axial direction at each arc-focusing surface lies above 1.5 $\mu$T/A.

9. In a contact arrangement according to claim 8, wherein the field strength in the axial direction amounts to at least 3 $\mu$T/A in the region of maximum field strength for the arc-focusing surfaces.

10. In a contact arrangement according to claim 1, wherein the contact surface is formed on a circular disk concentrically arranged to the contact axis and wherein at least one arc-focusing surface is present and lies on an annulus surrounding the contact surface.

11. In a contact arrangement according to claim 10, wherein at least two arc-focusing surfaces are present and lie on the annulus, and wherein the means for generating an axial magnetic field creates magentic fields having differing field directions.

12. In a contact arrangement according to claim 1, wherein the contact surface is an annulus formed in a ring-shaped member, wherein a single arc-focusing surface is formed in a disk-shaped member concentrically arranged within the ring-shaped member, said ring-shaped member having a transition surface extending between the contact surface and the surface of the arc-focusing surface.

13. In a contact arrangement according to claim 1, wherein the current-related specific field strength in an axial direction at each arc-focusing surface lies above 1.5 $\mu$T/A.

14. In a contact arrangement according to claim 12, wherein the field strength in the axial direction amounts to at least 3 $\mu$T/A in the region of maximum field strength for the arc-focusing surfaces.

* * * * *